US008091521B2

(12) United States Patent
Park

(10) Patent No.: US 8,091,521 B2
(45) Date of Patent: Jan. 10, 2012

(54) SELF-SUPERCHARGING ENGINE WITH FREEWHEELING MECHANISM

(76) Inventor: Gile Jun Yang Park, Burnaby (CA)

( * ) Notice: Subject to any disclaimer, the term of this patent is extended or adjusted under 35 U.S.C. 154(b) by 420 days.

(21) Appl. No.: 12/506,567

(22) Filed: Jul. 21, 2009

(65) Prior Publication Data

US 2009/0277402 A1 Nov. 12, 2009

Related U.S. Application Data

(63) Continuation-in-part of application No. 11/758,177, filed on Jun. 5, 2007, now abandoned.

(60) Provisional application No. 60/807,896, filed on Jul. 20, 2006.

(51) Int. Cl.
*F02B 25/00* (2006.01)
*F02B 75/02* (2006.01)
*F02B 33/00* (2006.01)

(52) U.S. Cl. .. 123/70 R; 123/316; 123/560; 123/DIG. 8

(58) Field of Classification Search ..... 123/52.3, 123/52.4, 52.6, 59.6, 70 R, 316, 560, 198 F, 123/DIG. 8
See application file for complete search history.

(56) References Cited

U.S. PATENT DOCUMENTS 1,601,548 A 9/1926 Zier et al.
1,634,468 A 7/1927 Muller
2,200,744 A 5/1940 Heinzelmann
2,596,410 A 5/1952 Jordan
3,537,437 A 11/1970 Paul et al.
3,581,628 A 6/1971 Williams
4,367,704 A 1/1983 Maucher et al.
4,638,637 A 1/1987 Kronogard et al.
5,265,564 A 11/1993 Dullaway
5,758,610 A 6/1998 Park
6,318,310 B1 11/2001 Clarke
6,553,977 B2 4/2003 Schmitz
6,830,535 B2 12/2004 Wylin
7,032,385 B2 4/2006 Gray, Jr.
7,080,622 B1 7/2006 Belloso
2006/0278181 A1 12/2006 Park

*Primary Examiner* — Noah Kamen
(74) *Attorney, Agent, or Firm* — Oyen Wiggs Green & Mutala LLP

(57) ABSTRACT

The invention is directed to a novel self-supercharging internal combustion engine with two pairs of three pistons and cylinders. A self-supercharging internal combustion engine comprising: (a) a first piston and cylinder with intake and exhaust valves, the piston being connected to a crankshaft; (b) a second piston and cylinder with intake and exhaust valves, the piston being connected to the crankshaft; (c) a third piston and cylinder of a size which is at least double the size of the first and second pistons, the third piston having a valve which enables air and fuel to be drawn into the cylinder, the third cylinder being connected to the intake valves of the first and second pistons and cylinders, the third piston being connected to the same crankshaft as the first and second pistons, and a corresponding second set of three pistons and cylinders, the three pistons being connected to a second crankshaft, each crankshaft being interconnected by meshing gears. A freewheeling mechanism can be included with the first and/or second crankshaft.

8 Claims, 4 Drawing Sheets

SELF-SUPERCHARGING ENGINE WITH FREEWHEELING MECHANISM

REFERENCE TO RELATED APPLICATION

This application is a continuation-in-part of application Ser. No. 11/758,177, filed Jun. 5, 2007, and claims the benefit of the filing date of U.S. provisional application Ser. No. 60/807,896, filed Jul. 20, 2006.

FIELD OF THE INVENTION

The invention relates to novel embodiments of internal combustion engine, including gasoline or diesel fuel powered engines. More particularly, this invention pertains to novel embodiments of air/fuel double-mix self-supercharging engines, including dual crankshaft and freewheeling mechanisms, which enable one or more of the pistons of the engine to be deactivated in certain operating conditions, thereby conserving fuel.

BACKGROUND OF THE INVENTION

In a conventional internal combustion engine, engine wear is reduced and operational efficiency and fuel consumption are improved if engine vibration is minimized, or some of the pistons can be deactivated at certain times when full power is not required. Vibration is reduced in an engine that is dynamically balanced. But a conventional engine which has only one crankshaft and four, six or eight pistons firing in sequence, is difficult to dynamically balance. Balance can be improved if the engine has more than one crankshaft.

In a conventional internal combustion engine, the speed of the engine is measured in rotations per minute ("rpm") of the crankshaft. Operating an engine at higher rpm means that the pistons go through more cycles over a given time. Thus the moving engine parts travel larger distances and engine wear is increased. While conventional internal sequential piston fired combustion engines with one crankshaft are inherently not dynamically balanced, they achieve better balance when operated at higher rpm. The higher rpm tends to override imbalance. An engine which has two crankshafts and accompanying pairs of pistons and cylinders provides better balance and operates smoothly at lower rpm. Supercharging engines which operate at higher compression ratios improve fuel combustion efficiency and conserve fuel.

U.S. Pat. No. 5,758,610, granted Jun. 2, 1998 to Gile Jun Yang Park, discloses an air-cooled self-supercharging four stroke internal combustion engine having four pistons which move in unison. There are two downward piston strokes in each four stroke cycle. The downward strokes of the pistons are used to compress the air in the crank case and supercharge the engine by forcing the more air and fuel into the two combustion chambers. Each combustion chamber serves two piston cylinders. The compressed air and fuel mixture is forced into only one combustion chamber during each downward stroke of the pistons. The two combustion chambers are charged with air and fuel on alternating downward piston strokes. The engine is air-cooled by the flow of the combustion intake air which passes through the crank case. At the same time, heat transferred from the engine pre-heats the intake air to improve combustion efficiency. The technology disclosed in U.S. Pat. No. 5,758,610 is incorporated herein by reference.

U.S. Pat. No. 6,318,310 B1, granted Nov. 20, 2001 to Clarke, discloses a dual mode internal combustion engine which may operate in either a power mode or an efficient mode. The dual mode internal combustion engine has two four-cycle combustion chambers and a two-cycle compression/expansion chamber. The valve system is set up to introduce a fluid charge into the compression/expansion cylinder during the power mode. The fluid charge is compressed in the compression/expansion chamber and one of the combustion chambers. During the efficiency mode, the fluid charge is expanded first in one of the combustion chambers and further expanded in the compression/expansion chamber.

U.S. Pat. No. 7,080,622 B1, issued Jul. 25, 2006 to Belloso, discloses a multi-cylinder internal combustion engine for a wheeled vehicle which is divided into at least two power producing sub-units designated primary and secondary sub-units. The primary sub-unit operates during all powered movement of the vehicle. The secondary sub-unit is activated only when additional power is needed. When inactive, no fuel is delivered to the secondary sub-unit, and there is no movement of its components. Each sub-unit has its own crankshaft, and the crankshafts are connected by a clutch mechanism interactive with a single output shaft that delivers power to the wheels of the vehicle.

U.S. Pat. No. 7,032,385 B2, issued Apr. 25, 2006 to Gray, Jr., discloses an internal combustion engine for a vehicle which provides variable displacement by selectively driving one or more engine crankshafts mounted within a single unitary engine block. In several embodiments, the crankshafts are connected to a common output shaft with a one-way clutch between the common output shaft and at least one of the crankshafts. In one aspect, starter gearing is independently associated with each of the first and second crankshafts and a starter is provided for selective engagement with the starter gearing of either of the crankshafts. In another aspect, an accessory drive for driving accessory systems of the vehicle receives power from any crankshaft which is operating, yet is isolated from any crankshaft that is not operating by a one-way clutch.

SUMMARY OF THE INVENTION

The invention is directed to a self-supercharging internal combustion engine comprising: (a) a primary triple piston and cylinder combination reciprocally connected to a first crankshaft, said primary triple piston and cylinder combination comprising: (i) a first piston and cylinder with intake and exhaust valves, the piston being connected to the first crankshaft in a first position; (ii) a second piston and cylinder with intake and exhaust valves, the piston being connected to the first crankshaft in a third position; (iii) a third piston and cylinder of a size which is at least double the size of the first and second pistons and cylinders, the third piston having a valve which enables air and fuel to be drawn into the third cylinder, the third cylinder being connected in alternating manner to the intake valves of the first and second pistons and cylinders, the third piston being connected to the first crankshaft in a second position between the first and third positions; (b) a secondary triple piston and cylinder combination reciprocally connected to a second crankshaft; said secondary triple piston and cylinder combination comprising: (i) a fourth piston and cylinder with intake and exhaust valves, the piston being connected to a second crankshaft in a first position; (ii) a fifth piston and cylinder with intake and exhaust valves, the piston being connected to the second crankshaft in a third position; and (iii) a sixth piston and cylinder of a size which is at least double the size of the fourth and fifth pistons and cylinders, the sixth piston having a valve which enables air and fuel to be drawn into the sixth cylinder, the sixth cylinder being connected in alternating manner to the intake valves of the fourth and fifth pistons and cylinders, the sixth piston being connected to the second crankshaft in a second position between the first and third positions; (c) the first and second crankshafts being connected by a combination of gears; said first and second crankshafts being parallel to one another; and said first crankshaft including an automatic freewheeling mechanism which enables the first crankshaft to provide positive drive on the second crankshaft, but the second crankshaft not to provide positive drive on the first crankshaft.

The automatic freewheeling mechanism can be a sprag clutch, a centrifugal clutch, a solenoid clutch, a hydraulic clutch, a pneumatic clutch, a bicycle clutch or any other acceptable automatic freewheeling or one-way clutch.

The self-supercharging internal combustion engine can include a first fuel injector for the third piston and cylinder and a second fuel injector for the sixth piston and cylinder. The self-supercharging internal combustion engine can include spark plugs in the first, second, fourth and fifth cylinders.

The first, second and third pistons and cylinders and the first crankshaft can be aligned in a first plane and the fourth, fifth and sixth pistons and cylinders and the second crankshaft can be aligned in a second plane. The second crankshaft can include an automatic freewheeling mechanism.

The invention can include an internal combustion engine with dual crankshafts and corresponding banks of pistons/cylinders and freewheeling mechanisms on each crankshafts. The engine can be two-cycle or four-cycle, or gasoline or diesel fuel powered.

DRAWINGS

Exemplary embodiments are illustrated in referenced figures of the drawings. It is intended that the embodiments and figures disclosed herein are to be considered illustrative rather than restrictive.

DETAILED DESCRIPTION OF SPECIFIC EMBODIMENTS OF THE INVENTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

The self-supercharging internal combustion engine in a first embodiment of the invention comprises a pair of three cylinders with three reciprocal pistons connected to a respective pair of crankshafts. Two of the pistons in respective cylinders in each pair fire in alternating order while the third piston and cylinder in each pair is a supercharging piston which receives air/fuel, compresses it and delivers the compressed air/fuel to the first or second cylinders in each pair in alternating order. The size of the supercharging piston and cylinder in each pair is at least double the size of the two firing piston and cylinders in each pair in order to provide a supercharging effect. In two construction styles, the two firing pistons and cylinders in each pair can be located on either side of the supercharging piston and cylinder, or in a "V"-shaped pattern. To create higher power engines with self-supercharging effect, the number of piston/cylinders can be multiples of 6, regardless of whether an "in-line" or "V" engine orientation is used. In one embodiment, the pair of respective three pistons and cylinders, with respective crankshafts can be arranged in parallel. This pair construction provides more effective combustion, better mechanical balancing, less vibration, more power and less pollution with a small size engine. The engine can be a two-cycle engine, a fuel injection gasoline burning engine or a diesel engine with fuel injector.

Figure 1:
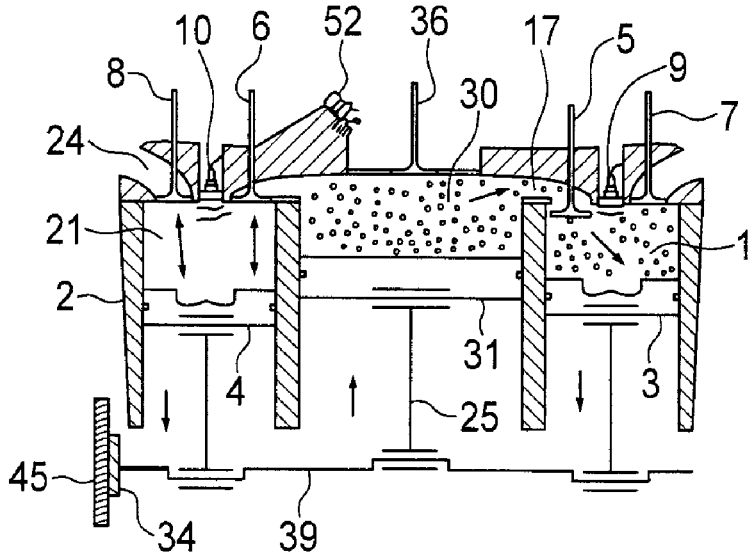
FIG. 1 illustrates a side cut-away view of one of a pair of three-cylinder/piston self-supercharging engines during the air/fuel intake cycle of the first piston/cylinder.

FIG. 1 illustrates a side cut-away view of one of the pair of three-cylinder/piston self-supercharging engines during the air/fuel intake cycle of the first piston/cylinder. As seen in FIG. 1, the middle cylinder 30 and piston 31 are at least twice as large as each of the adjacent cylinders 1 and 2 and respective pistons 3 and 4. This design provides a supercharging effect when compressed air/fuel is delivered from cylinder 30 to either cylinder 1 or 2, as dictated by respective valves 5 or 6. FIG. 1 also shows a fuel injector 52 over cylinder 30 and freewheeling mechanism 34 and gear 45 at the front of crankshaft 39.

As seen in FIG. 1, the operation of the three pistons and cylinders during the air/fuel intake cycle of the first piston/cylinder is described as follows:

Cylinder 1: As crankshaft 39 rotates, piston 3 moves downward. Exhaust valve 7 is closed. Air/fuel intake valve 5 is open so that compressed pre-mix air/fuel is passed into piston cylinder 1 from middle cylinder 30.

Cylinder 30: As crankshaft 39 rotates, large piston 31 moves upward. Air/fuel intake valve 36 is closed. Pre-mixed air/fuel is compressed and delivered to cylinder 1 through intake port 17 and open valve 5.

Cylinder 2: As crankshaft 39 rotates, air/fuel intake valve 6 and exhaust valve 8 are closed. Spark plug 10 is ignited at the top of cylinder 2 in area 21. A fuel injector 52 is also shown. The power generated by the ignited compressed air/fuel mixture in cylinder 2 pushes piston 4 downward.

Figure 2:
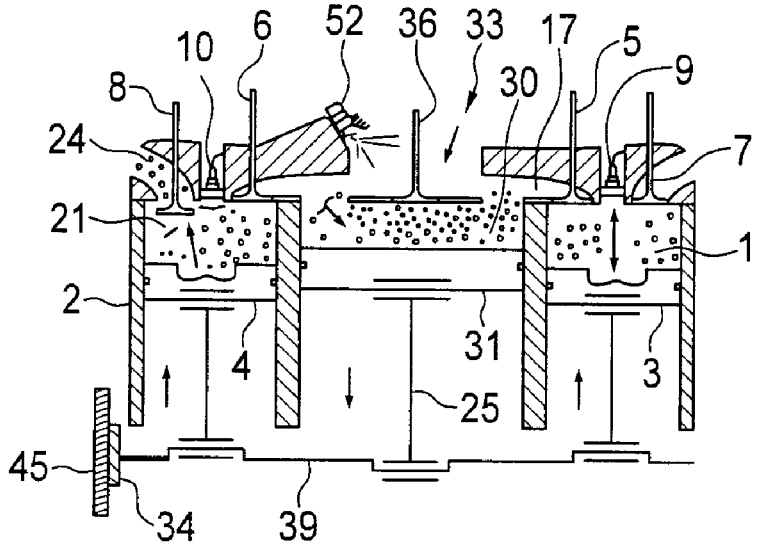
FIG. 2 illustrates a side cut-away view of one of a pair of three-cylinder/piston self-supercharging engines during the air/fuel compression cycle of the first piston/cylinder.

FIG. 2 illustrates a side cut-away view of one of the pair of three-cylinder/piston self-supercharging engines during the air/fuel compression cycle of the first piston/cylinder. The operation of the three piston and cylinders during this the air/fuel compression cycle is described as follows:

Cylinder 1: As crankshaft 39 rotates, air/fuel intake valve 5 and exhaust valve 7 are closed. Piston 3 moves upward so that pre-mix air/fuel taken from cylinder 30 during the first stage shown in FIG. 1 is compressed in cylinder 1.

Cylinder 30: As crankshaft 39 rotates, middle cylinder piston 31 moves downward. Air/fuel intake valve 36 is open. Air and fuel from fuel injector 52 are injected into middle cylinder 30 through air/fuel intake port 33.

Cylinder 2: Air/fuel intake valve 6 is closed and exhaust valve 8 is open. Piston 4 moves upward. Exhaust from burnt gas in cylinder 2 is exhausted to atmosphere through exhaust port 24.

Figure 3:
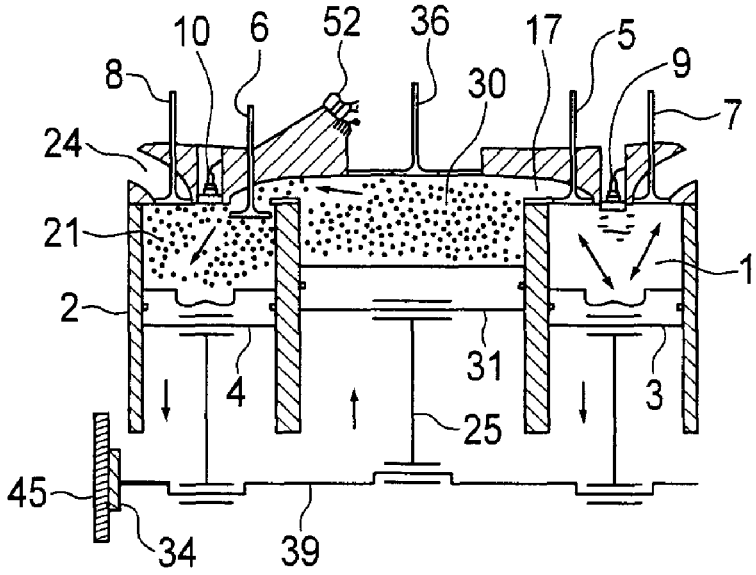
FIG. 3 illustrates a side cut-away view of one of a pair of three-cylinder/piston self-supercharging engines during the combustion cycle of the first piston/cylinder.

FIG. 3 illustrates a side cut-away view one of the pair of three-cylinder/piston self-supercharging engines during the combustion cycle of the first piston/cylinder. The operation of the three piston and cylinders during this combustion cycle is described as follows:

Cylinder 1: As crankshaft 39 rotates, air/fuel intake valve 5 and exhaust valve 7 are closed. Spark plug 9 ignites the compressed air/fuel mixture in combustion chamber 1. Piston 3 is forced downward by the burning air/fuel mixture.

Cylinder 30: As crankshaft 39 rotates, middle cylinder piston 31 is moving upward. Air/fuel intake valve 36 is closed. The compressed air/fuel mixture in cylinder 30 is forced into cylinder 2 through open air/fuel intake valve 6.

Cylinder 2: As crankshaft 39 rotates, piston 4 is moving downward while exhaust valve 8 is closed. Since air/fuel intake valve 6 is open, pre-mix air/fuel from cylinder 30 is delivered into cylinder 2.

Figure 4:
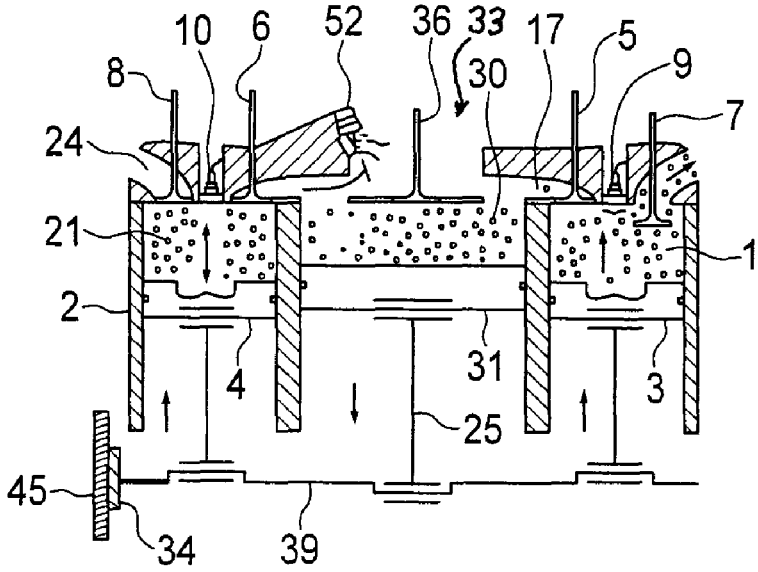
FIG. 4 illustrates a side cut-away view of one of a pair of three-cylinder/piston self-supercharging engines during the exhaust cycle of the first piston/cylinder.

FIG. 4 illustrates a side cut-away view of one of the pair of three-cylinder/piston self-supercharging engines during the exhaust cycle of the first piston/cylinder. The operation of the three pistons and cylinders during this exhaust cycle is described as follows:

Cylinder 1: As crankshaft 39 rotates, piston 3 is moving upward while air/fuel intake valve 5 is closed. Exhaust valve 7 is open so that exhaust gas 13 in cylinder 1 is vented to atmosphere.

Cylinder 30: As crankshaft 39 rotates, middle piston 31 is moving downward while air/fuel intake valve 36 is open. Air and fuel from fuel injector 52 are taken into middle cylinder 30 through open air/fuel intake port 33.

Cylinder 2: As crankshaft 39 rotates, piston 4 is moving upward while air/fuel intake valve 6 and exhaust valve 8 are closed. Air/fuel pre-mix taken previously from cylinder 30 is compressed in cylinder 2.

Figure 5:
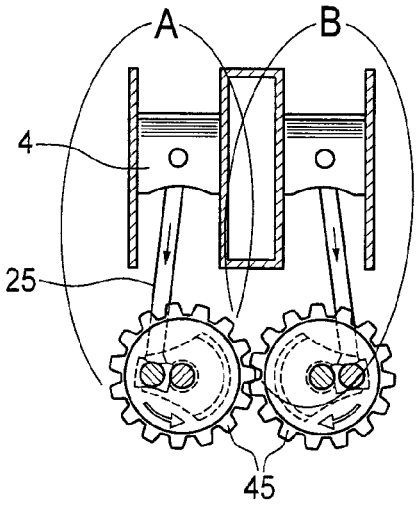
FIG. 5 is a front cut-away view of a pair of three cylinder/piston supercharging engines with dual crankshafts.

FIG. 5 is a front cut-away view of a pair of three cylinder/piston supercharging engines, identified as "A" and "B" with dual crankshafts. In FIG. 5, two sets of three piston/cylinder combinations are arranged in parallel, each connected by connecting rods 25 to separate crankshafts 39 (see FIG. 6) also arranged in parallel. The two crankshafts 39 are connected by meshing gears 45.

Figure 6:
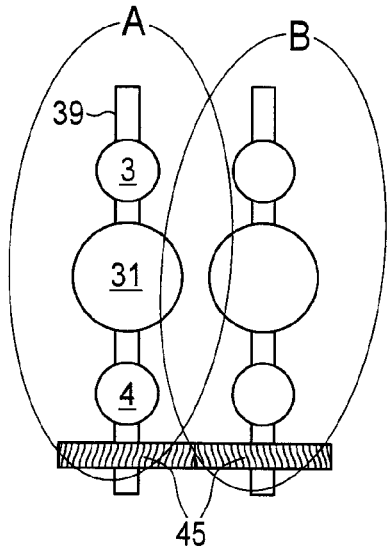
FIG. 6 is a top cut-away view of a pair of three cylinder/piston supercharging engines with dual crankshafts.

FIG. 6 is a top cut-away view of a parallel pair of three cylinder/piston supercharging engines with a pair of parallel crankshafts 39 and meshing gears 45 at the front of each crankshaft. The counter-rotating dual crankshafts provide balance and smooth power generation. With the engine running smoothly, there is less fuel consumption, less vibration, less pollution, less friction and more efficient power generation.

Figure 7:
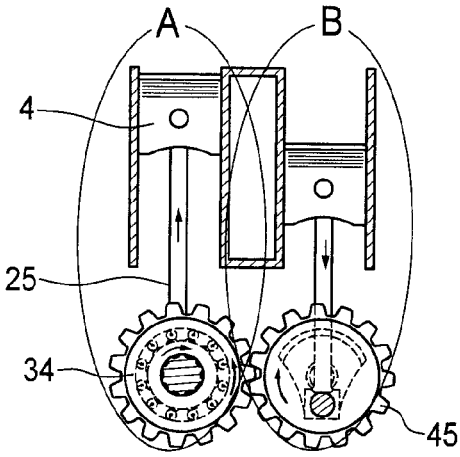
FIG. 7 is a front cut-away view of a pair of three cylinder/piston supercharging engines with dual crankshafts, including a freewheeling mechanism on one of the crankshafts.

In a second embodiment of the invention, FIG. 7 is a front cut-away view of a pair of three cylinder/piston supercharging engines, identified as "A" and "B", with dual crankshafts, including a freewheeling mechanism 34 on one of the crankshafts. In FIG. 7, the configuration is similar to the configuration in FIG. 5 except that one of the gears 45 has a freewheeling mechanism 34.

Figure 8:
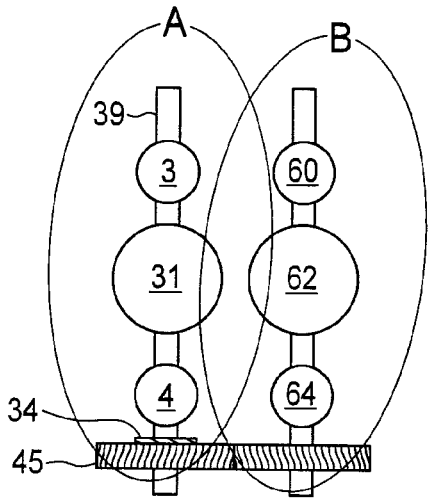
FIG. 8 is a top cut-away view of a pair of three cylinder/piston supercharging engines with dual crankshafts, including a freewheeling mechanism on one of the crankshafts.

FIG. 8 is a top cut-away view of a pair of three cylinder/piston supercharging engines, with dual crankshafts, identified as "A" and "B", including a freewheeling mechanism 34 on one of the crankshafts 39. The two gears 45 mesh with one another.

A freewheeling mechanism is a one-way drive mechanism. Automotive Mechanics, William H. Crouse, 6th Edition, McGraw-Hill, Chapter 31, discloses a freewheeling mechanism. In a freewheeling mechanism, positive drive is provided by a first shaft or wheel on a second shaft or wheel. However, the second shaft or wheel cannot drive the first wheel or shaft. When the first shaft or wheel is slowed or stopped, the second shaft or wheel "freewheels", and continues turning. In the context of clutches, or planetary gear sets, the freewheeling mechanism is sometimes described as an overrunning clutch. Freewheeling mechanisms can include sprag clutches, centrifugal clutches, bicycle clutches, solenoid clutches, hydraulic clutches, pneumatic clutches, or other suitable clutches.

With the freewheeling mechanism 34 installed on the "A" crankshaft, as shown in FIGS. 7 and 8, the two pistons 60 and 64, powered by fuel injected in the air/fuel compression chamber above piston 62, drive the "B" crankshaft and this action is transferred via gear 45 to the lateral "A" crankshaft. Likewise, the two pistons 3 and 4, powered by fuel injected in the compression chamber 30 above piston 31, drive the "A" crankshaft. However, when the vehicle driven by the engine is coasting, or the engine is idling, fuel to the "B" set of three pistons is continued but fuel to the "A" set of three pistons 3, 31 and 4 is stopped and due to the freewheeling mechanism 34, the "A" set of pistons can idle, thereby conserving fuel.

Figure 9:
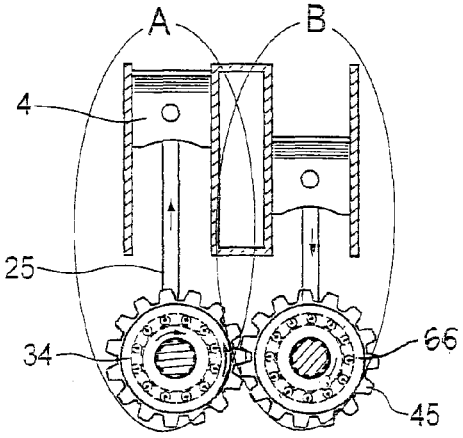
FIG. 9 is a front cut-away view of a pair of three cylinder/piston supercharging engines with dual crankshafts, including freewheeling mechanisms on both crankshafts.

FIG. 9 is a front cut-away view of a third embodiment of the invention comprising a pair of three cylinder/piston supercharging engines with dual crankshafts, including freewheeling mechanisms 34, 66 on both crankshafts.

Figure 10:
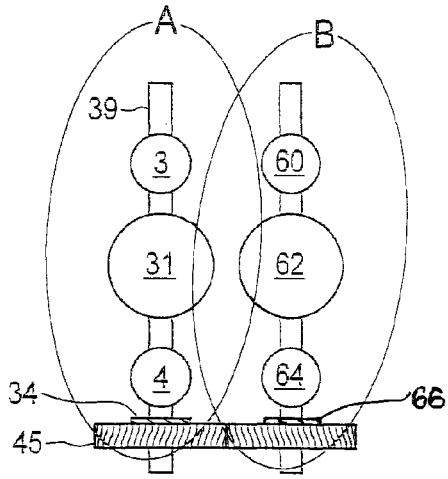
FIG. 10 is a top cut-away view of a pair of three cylinder/piston supercharging engines with dual crankshafts, including a freewheeling mechanism on both crankshafts.

FIG. 10 is a top cut-away view of the third embodiment of the invention comprising a pair of three cylinder/piston supercharging engines with dual crankshafts, including a freewheeling mechanism on both crankshafts.

When a second freewheeling mechanism 66 is installed on the "B" crankshaft, as shown in FIGS. 9 and 10, it is possible, depending on which crankshaft and piston/cylinder combination is the power train, to idle either the "A" crankshaft and piston/cylinder combination, or the "B" crankshaft and piston/cylinder combination. In this way, wear over time can be equalized over time in the engine. Wear tends to occur at a higher rate in the crankshaft and piston/cylinder combination that is powered, than in the idle crankshaft and piston/cylinder combination. Utilizing two freewheeling mechanisms, one on each crankshaft, enables one crankshaft piston/cylinder combination to be the power train for a time, and then the other crankshaft piston/cylinder combination to be the power combination for a time.

With a freewheeling mechanism installed in each crankshaft, the engine can be controlled by a PCMS (program computer monitor system) or a PCM (power control modular) to enable alternate crankshaft operation. For instance, the "A"

crankshaft can run as the primary power train for 5,000 km and then become the idle train. The "B" crankshaft can then be run as the primary power train until it reaches 5,000 km, with the "A" crankshaft as the idle train. In this way, engine wear is equalized in both crankshaft combinations, thereby prolonging the life of the engine.

Another advantage of the dual freewheeling mechanism configuration is that if, for example, crankshaft "A" breaks down, the vehicle does not need to be towed because it can be driven to a garage for repair by using crankshaft "B" as the power train.

Figure 11:
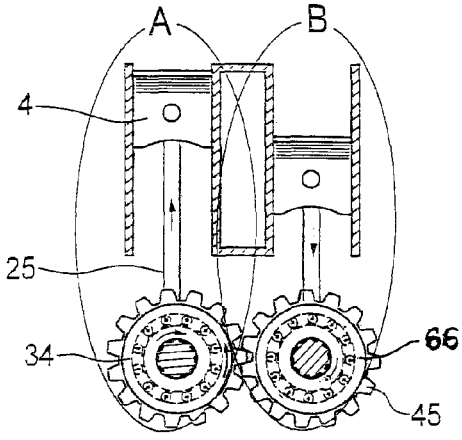
FIG. 11 is a front cut-away view of a pair of three cylinder/piston engines with dual crankshafts and freewheeling mechanisms on both crankshafts.

FIG. 11 is a front cut-away view of a fourth embodiment of the invention, including a pair of three cylinder/piston engines with dual crankshafts and freewheeling mechanisms on both crankshafts. The engines in this fourth embodiment can be two-cycle or four-cycle engines.

Figure 12:
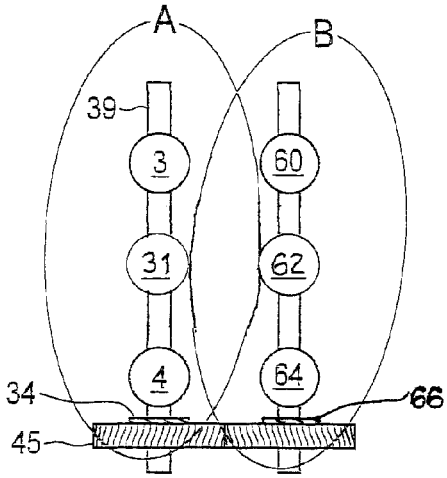
FIG. 12 is a top cut-away view of a pair of three cylinder/piston engines with dual crankshafts, which can be two-cycle or four-cycle engines, and freewheeling mechanisms on both crankshafts.

FIG. 12 is a top cut-away view of a pair of three cylinder/piston engines with dual crankshafts and freewheeling mechanisms on both crankshafts. The dual crankshaft, dual freewheeling embodiment illustrated in FIGS. 11 and 12 can be operated in the same manner as the third embodiment that is illustrated in FIGS. 9 and 10 and discussed above. There is no self-supercharging capability in the fourth embodiment illustrated in FIGS. 11 and 12 because the pistons and cylinders are all of equal diameter.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A self-supercharging internal combustion engine comprising:

(a) a primary triple piston and cylinder combination reciprocally connected to a first crankshaft, said primary triple piston and cylinder combination comprising:

(i) a first piston and cylinder with intake and exhaust valves, the piston being connected to the first crankshaft in a first position;

(ii) a second piston and cylinder with intake and exhaust valves, the piston being connected to the first crankshaft in a third position;

(iii) a third piston and cylinder of a size which is at least double the size of the first and second pistons and cylinders, the third piston having a valve which enables air and fuel to be drawn into the third cylinder, the third cylinder being connected in alternating manner to the intake valves of the first and second pistons and cylinders, the third piston being connected to the first crankshaft in a second position between the first and third positions;

(b) a secondary triple piston and cylinder combination reciprocally connected to a second crankshaft; said secondary triple piston and cylinder combination comprising:

(i) a fourth piston and cylinder with intake and exhaust valves, the piston being connected to a second crankshaft in a first position;

(ii) a fifth piston and cylinder with intake and exhaust valves, the piston being connected to the second crankshaft in a third position; and (iii) a sixth piston and cylinder of a size which is at least double the size of the fourth and fifth pistons and cylinders, the sixth piston having a valve which enables air and fuel to be drawn into the sixth cylinder, the sixth cylinder being connected in alternating manner to the intake valves of the fourth and fifth pistons and cylinders, the sixth piston being connected to the second crankshaft in a second position between the first and third positions;

(c) the first and second crankshafts being connected by a combination of gears; said first and second crankshafts being parallel to one another; and said first crankshaft including an automatic freewheeling mechanism which enables the first crankshaft to provide positive drive on the second crankshaft, but the second crankshaft not to provide positive drive on the first crankshaft.

2. A self-supercharging internal combustion engine as claimed in claim 1 wherein the automatic freewheeling mechanism is a sprag clutch, a centrifugal clutch, a solenoid clutch, a hydraulic clutch, a pneumatic clutch, a bicycle clutch, a one-way clutch.

3. A self-supercharging internal combustion engine as claimed in claim 1 including a first fuel injector for the third piston and cylinder and second fuel injector for the sixth piston and cylinder.

4. A self-supercharging internal combustion engine as claimed in claim 1 including spark plugs for the first, second, fourth and fifth pistons and cylinders.

5. A self-supercharging internal combustion engine as claimed in claim 1 wherein the first, second and third pistons and cylinders and the first crankshaft are aligned in a first plane and the fourth, fifth and sixth pistons and cylinders and the second crankshaft are aligned in a second plane.

6. An internal combustion engine comprising:

(a) a primary triple piston and cylinder combination reciprocally connected to a first crankshaft, said primary triple piston and cylinder combination comprising:

(i) a first piston and cylinder with intake and exhaust valves, the piston being connected to the first crankshaft in a first position;

(ii) a second piston and cylinder with intake and exhaust valves, the piston being connected to the first crankshaft in a second position;

(iii) a third piston and cylinder with intake and exhaust valves, the third piston being connected to the first crankshaft in third position;

(b) a secondary triple piston and cylinder combination reciprocally connected to a second crankshaft; said secondary triple piston and cylinder combination comprising:

(i) a fourth piston and cylinder with intake and exhaust valves, the piston being connected to a second crankshaft in a first position;

(ii) a fifth piston and cylinder with intake and exhaust valves, the piston being connected to the second crankshaft in a second position; and (iii) a sixth piston and cylinder with intake and exhaust valves, the sixth piston being connected to the second crankshaft in a third position;

(c) the first and second crankshafts being connected by a combination of gears; said first and second crankshafts being parallel to one another; said first crankshaft including an automatic freewheeling mechanism which enables the first crankshaft to provide positive drive on the second crankshaft, but the second crankshaft not to provide positive drive on the first crankshaft, and said second crankshaft including an automatic freewheeling mechanism which enables the second crankshaft to provide positive drive on the first crankshaft but the first crankshaft not to provide positive drive on the second crankshaft.

7. An internal combustion engine as claimed in claim 6 wherein the engine is a two-cycle engine.

8. An internal combustion engine as claimed in claim 6 wherein the engine is a four-cycle engine.

* * * * *